US007406289B2

(12) United States Patent
Lee

(10) Patent No.: US 7,406,289 B2
(45) Date of Patent: Jul. 29, 2008

(54) IMAGE FORMING APPARATUS USING A CLEANING DEVICE AND CLEANING METHOD THEREOF

(75) Inventor: Jun-Hee Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 98 days.

(21) Appl. No.: 11/087,697

(22) Filed: Mar. 24, 2005

(65) Prior Publication Data

US 2005/0238396 A1 Oct. 27, 2005

(30) Foreign Application Priority Data

Apr. 27, 2004 (KR) ..... 10-2004-0028929

(51) Int. Cl.
*G03G 21/00* (2006.01)
*G03G 15/16* (2006.01)

(52) U.S. Cl. ..... 399/349; 399/101

(58) Field of Classification Search ..... 399/349–351, 399/353, 354, 357, 101
See application file for complete search history.

(56) References Cited

U.S. PATENT DOCUMENTS

| | | | | |
|---|---|---|---|---|
| 3,656,200 | A | 4/1972 | Riley | |
| 4,515,467 | A * | 5/1985 | Suzuki | 399/354 |
| 4,982,240 | A * | 1/1991 | Nakano | 399/350 |
| 5,081,505 | A | 1/1992 | Ziegelmuller | |
| 5,148,227 | A * | 9/1992 | Senba et al. | 399/349 |
| 5,233,399 | A * | 8/1993 | Shiino et al. | 399/353 |
| 5,249,025 | A * | 9/1993 | Nakazawa et al. | 399/349 |
| 5,258,816 | A * | 11/1993 | Haneda et al. | 399/351 |
| 6,311,031 | B1 * | 10/2001 | Hirano | 399/101 |
| 2001/0026718 | A1 * | 10/2001 | Okubo | 399/353 |
| 2004/0057761 | A1 * | 3/2004 | Ito | 399/349 |

FOREIGN PATENT DOCUMENTS

| | | | |
|---|---|---|---|
| JP | 56-042258 | | 4/1981 |
| JP | 60-057880 | | 4/1985 |
| JP | 63210981 | A * | 9/1988 |
| JP | 01262577 | A * | 10/1989 |
| JP | 02-264992 | | 10/1990 |

(Continued)

OTHER PUBLICATIONS

European Patent Office Search Report dated Sep. 5, 2005 for European Patent Application No. EP 05 25 2577.

*Primary Examiner*—Susan S Lee
(74) *Attorney, Agent, or Firm*—Roylance, Abrams, Berdo & Goodman, L.L.P.

(57) ABSTRACT

Disclosed is a cleaning device, a cleaning method and an image forming apparatus applied with the cleaning device and the cleaning method. The cleaning device includes a first cleaning member for removing waste developers remaining on one of a transfer belt and a photosensitive medium; a support bracket for supporting the first cleaning member; a second cleaning member being disposed in one side of the first cleaning member and serving a role in removing the waste developers remaining on the first cleaning member; a developer transfer member for transferring the removed waste developers; and a base bracket unit for receiving the developer transfer member. On the basis of the cleaning device and the cleaning method, the image forming apparatus is provided with an effect on improved cleaning efficiency.

16 Claims, 12 Drawing Sheets

FOREIGN PATENT DOCUMENTS

| | | | | |
|---|---|---|---|---|
| JP | 05-72956 | | | 3/1993 |
| JP | 07072762 | A | * | 3/1995 |
| JP | 10-274910 | | | 10/1998 |
| JP | 2001-296780 | | | 10/2001 |
| JP | 2001-343838 | | | 12/2001 |
| JP | 2002-082537 | | | 3/2002 |
| JP | 2002-196644 | | | 7/2002 |
| KR | 1991-0020519 | | | 12/1991 |
| KR | 100189164 | | | 1/1999 |
| KR | 2000-0005890 | | | 4/2000 |

* cited by examiner

IMAGE FORMING APPARATUS USING A CLEANING DEVICE AND CLEANING METHOD THEREOF

CROSS-REFERENCE TO RELATED APPLICATIONS

This application claims the benefit under 35 U.S.C. § 119 (a) of Korean Patent Application No. 2004-28929, entitled "Cleaning Device, Cleaning Method and Image Forming Apparatus With Using the Device and Method, filed on Apr. 27, 2004, the entire contents of which are hereby incorporated by reference.

BACKGROUND OF THE INVENTION

1. Field of the Invention

The present invention relates to an image forming apparatus such as a photocopier, a printer, a facsimile, and a multifunction machine. More particularly, the present invention relates to a cleaning device and a cleaning method using the cleaning device for image forming apparatuses.

2. Description of the Related Art

Generally, an image forming apparatus is classified into a monochrome image forming apparatus and a color image forming apparatus. The monochrome image forming apparatus generates an image in black-and-white by using a monochromic developer. Alternatively, the color image forming apparatus generates an image in color by using color developers typically based on the following colors: magenta, cyan, yellow and black.

As is also well known, an electrophotographic image forming apparatus generates an image by sequential steps. In the case of the monochrome image forming apparatus, first, a charging unit charges a photosensitive medium with a predetermined electric potential. Then, a scanning unit scans a laser beam to generate an electrostatic latent image. The electrostatic latent image is developed into a monochrome developer and then transferred into a visible image on a printing paper. In the case of the color image forming apparatus, the electrostatic latent image is developed into each color developer on the photosensitive medium. Afterwards, a superimposed image is transferred to a transfer belt, and a full color image is developed on a printing paper. Additionally, a cleaning device may be provided for removing waste developers remaining after being transferred by the transfer belt or the photosensitive medium.

FIG. 1 is a diagram schematically showing a conventional cleaning device of a wet-type color image forming apparatus using a liquid developer.

As shown, the cleaning device 50 comprises a transfer belt 40; a cleaning blade 52 is disposed on one side of the transfer belt 40 and makes contact with the transfer belt 40; and a support bracket 54 supports the cleaning blade 52. Usually, the cleaning blade 52 is made of a ductile material having elasticity, and the support bracket 54 is fixed to the cleaning blade 52 and to a body (not shown) of the image forming apparatus or another support bracket (not shown).

Referring to FIG. 1, cleaning steps and steps of generating an image in a conventional cleaning device will be described in detail. A scanning unit 20 generates an electrostatic latent image on photosensitive drums 10 for each individual color, and color developers supplied from each of several color developing units 30 are transferred to the photosensitive drums 10. The color developers are superimposed on the transfer belt 40. The superimposed color developers are then transferred into a visible image on printing paper P passing through a drive roller 41 and a transfer roller 60. Waste developer 70 remaining after the transfer stays on the transfer belt and moves along with the transfer belt 40.

As shown in FIG. 1, the remaining waste developer 70 is removed by the cleaning blade 52 disposed in contact with the transfer belt 40, so that the remaining waste developer 70 flows by gravity along one surface of the cleaning blade 52.

However, the conventional cleaning device has a problem in that the remaining waste developer 70 is deposited on the cleaning blade 52. In the case of a high-speed printing process, or in the case of a high quantity of materials being printed, waste developer deposition occurs due to an increased amount of the remaining waste developer 70. Particularly, in instances using a liquid type developer, because of viscousness of the developers, greater quantities of developers are deposited on one surface of the cleaning blade 52.

As the remaining waste developer 70 is deposited on the cleaning blade 52, pressure is created as the cleaning blade 52 presses the transfer belt 40, e.g., a pressure exerted in a predetermined direction denoted by arrow 'Y' in FIG. 1, increases, and this increased pressure may result in damage to a surface of the transfer belt 40. Also, cleaning performance may decrease, which may further increase the likelihood of generating an incomplete and unstable image.

Accordingly, there is a continual need for image apparatuses with improved cleaning devices and cleaning methods for removing waste developers.

SUMMARY OF THE INVENTION

An aspect of the present invention is to solve at least the above problems and/or disadvantages and to provide at least the advantages described below. Accordingly, an aspect of the present invention is to provide a cleaning device of an image forming apparatus, improved in cleaning performance, and a cleaning method thereof.

Another object of the present invention is to provide an image forming apparatus having an improved cleaning device.

The foregoing and other objects are substantially realized by providing a cleaning device comprising a first cleaning member for removing waste developers remaining on one of a transfer belt and a photosensitive medium, a support bracket for supporting the first cleaning member, and a second cleaning member being disposed on one side of the first cleaning member to remove the waste developers remaining on the first cleaning member. Therefore, on the basis of the above configuration of the cleaning device, it is possible to prevent the waste developers from being deposited on the first cleaning member, thereby improving cleaning efficiency.

Also, the cleaning device further comprises a developer transfer member for transferring the removed waste developers. Preferably, the removed waste developer is transferred to a waste developer disposal bin formed at one side of the developer transfer member.

The cleaning device further comprises a base bracket unit for receiving the developer transfer member. The base bracket unit temporarily collects the removed waste developers and provides a path for transferring developers. As a result, the developers can be transferred with an improved efficiency.

The base bracket unit comprises a main bracket body for collecting the removed waste developers and a compress unit for cleaning the second cleaning member. Particularly, the compress unit is preferably integrally connected with the main bracket body, and thus, the integrally connected compress unit is capable of removing the waste developers remaining on or absorbing into the second cleaning member.

Also, the second cleaning member is formed as a rotatable roller comprising a roller shaft being a rotation axle and an absorption member enclosing an outer surface of the roller shaft. Preferably, the absorption member is formed as a sponge. Herein, since the sponge has elasticity and a capability of absorbing the developers, the waste developers can be effectively removed. Also, there is less concern about damages to the photosensitive medium or the transfer belt.

Furthermore, the second cleaning member can be formed in a rotatable roller including a rotation shaft being a rotation axle and at least one elastic blade coupled with the roller shaft. Preferably, the elastic blade is made of a urethane-based material.

Particularly, the first cleaning member and the second cleaning member are disposed with a predetermined distance of approximately 0.1 mm to 0.3 mm. If the distance between the first cleaning member and the second cleaning member is less than this range, the transfer belt and the photosensitive medium may be damaged and, if the distance is greater than this range, the cleaning efficiency is reduced.

Preferably, the cleaning device further includes a pre-cleaning member for removing the waste developers remaining on the photosensitive medium or the transfer belt before the first cleaning member cleans the waste developers.

Herein, it is preferred that the pre-cleaning member includes a roller shaft being a rotation axle and an absorption member enclosing an outer surface of the roller shaft.

In addition, the first cleaning member is disposed substantially below the transfer belt while being in contact with a surface of the transfer belt. As a result, the waste developer removed by the first cleaning member falls by gravity.

The foregoing and other objects are also substantially realized by providing an image forming apparatus, comprising a main body, a scanning unit being disposed within the main body for generating an electrostatic latent image on a photosensitive medium, an image forming unit for generating a visible image on the photosensitive medium by using a developer, and transferring the visible image to a piece of printing paper, and a cleaning device for removing waste developers remaining on the photosensitive medium. The cleaning device applied to the image forming apparatus comprises a first cleaning member for removing waste developers remaining on the photosensitive medium, a support bracket for supporting the first cleaning member, and a second cleaning member being disposed on one side of the first cleaning member for removing the waste developers remaining on the first cleaning member.

Herein, the cleaning device applied to the image forming apparatus preferably further comprises a developer transfer member for transferring the removed waste developers, and a base bracket unit for receiving the developer transfer member.

Also, the second cleaning member of the cleaning device applied to the image generation apparatus is formed as a rotatable roller including a roller shaft as a rotation axle and an absorption member enclosing an outer surface of the roller shaft.

In accordance with still another aspect of the present invention, there is provided an image forming apparatus, comprising a main body, a scanning unit being disposed within the main body and serving a role in generating an electrostatic latent image on a photosensitive medium, a developing unit generating a visible image on the photosensitive medium by using a developer, a transfer unit including a transfer belt for transferring the visible image on the photosensitive medium to a piece of printing paper, and a cleaning device for removing waste developers remaining on the transfer belt.

Particularly, the cleaning device applied to the image forming apparatus comprises a first cleaning member for removing waste developer remaining on the transfer belt. A support bracket for supporting the first cleaning member and a second cleaning member being disposed on one side of the first cleaning member for removing the waste developers remaining on the first cleaning member.

Herein, the cleaning device applied to the image forming apparatus preferably further comprises a developer transfer member for transferring the removed waste developers and a base bracket unit for receiving the developer transfer member.

Also, the second cleaning member of the cleaning device applied to the image forming apparatus is formed as a rotatable roller including a roller shaft being a rotation axle and an absorption member enclosing an outer surface of the roller shaft.

Furthermore, the first cleaning member of the cleaning device applied to the image forming apparatus is disposed substantially below the transfer belt while being in contact with a surface of the transfer belt.

In accordance with further aspect of the present invention, there is provided a cleaning method of an image forming apparatus, including the steps of removing waste developers remaining on one of a transfer belt and a photosensitive medium of an image forming apparatus through the use of a first cleaning member; and cleaning waste developers remaining on the first cleaning member through the use of a second cleaning member.

Preferably, the cleaning method further includes the step of pre-cleaning the waste developer remaining on one of the transfer belt and the photosensitive medium prior to the step of removing the waste developer by employing the first cleaning member.

Also, the cleaning method further includes the step of transferring the removed waste developers to a predetermined region.

It is preferable that the cleaning method further includes the step of cleaning the waste developers remaining on the second cleaning member.

On the basis of the cleaning device, the cleaning method and the image forming apparatus applied with the same cleaning device and the method, there is provided an effect on reduced amounts of the waste developers deposited on the first cleaning member, and as a result of this effect, a linear pressure, exerted by the first cleaning member to the transfer belt or the photosensitive medium, for instance, a photosensitive drum, can be maintained consistently. Accordingly, an improvement on cleaning efficiency can be further achieved.

Also, because of the consistently maintained linear pressure, there are less chances that the transfer belt or the photosensitive medium is damaged, and thus, durability of a developer is elongated.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, and features, and advantages of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for conciseness.

Figure 2:
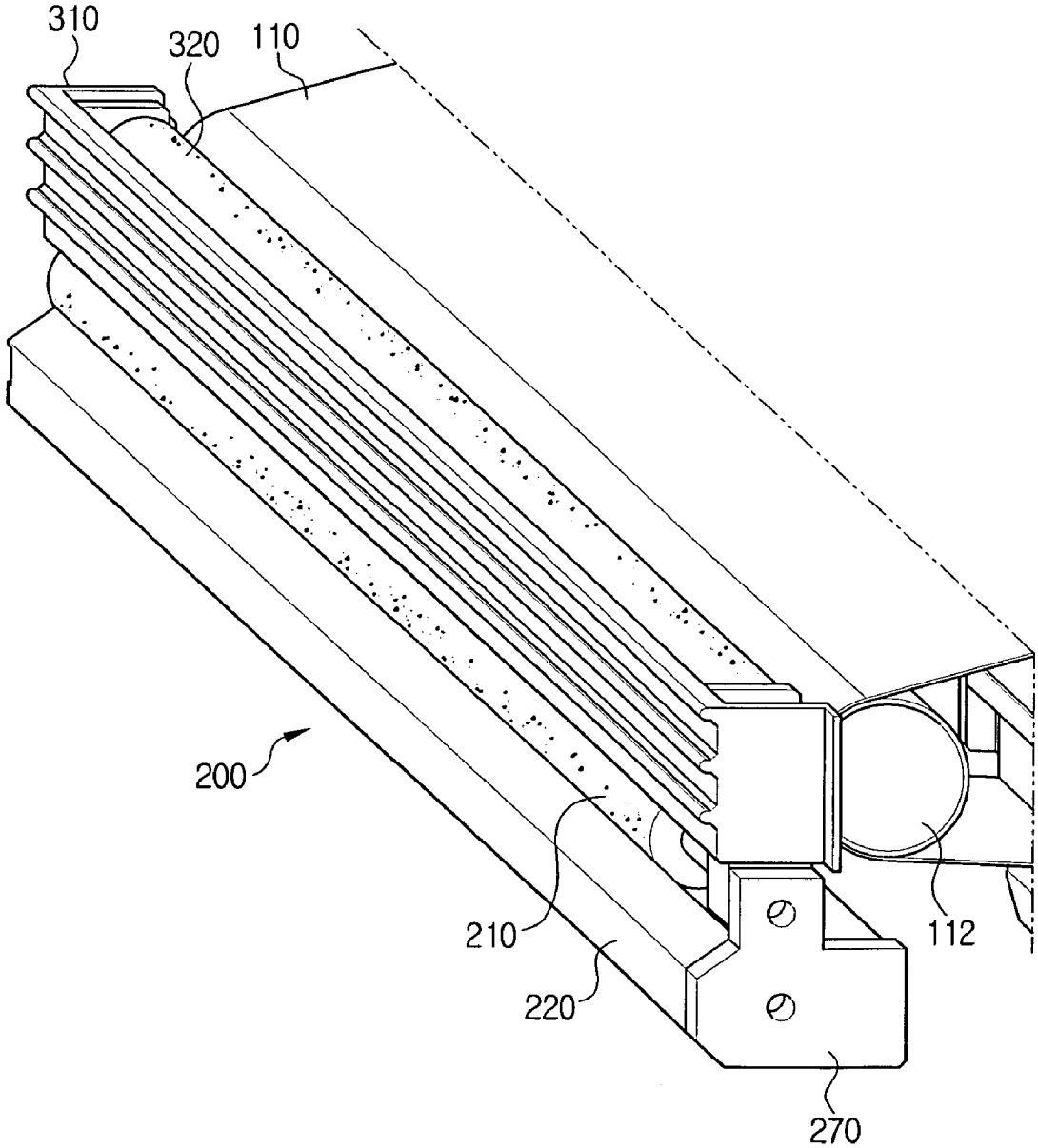
FIG. 2 is a perspective view showing a cleaning device in accordance with a first embodiment of the present invention.
Figure 3:
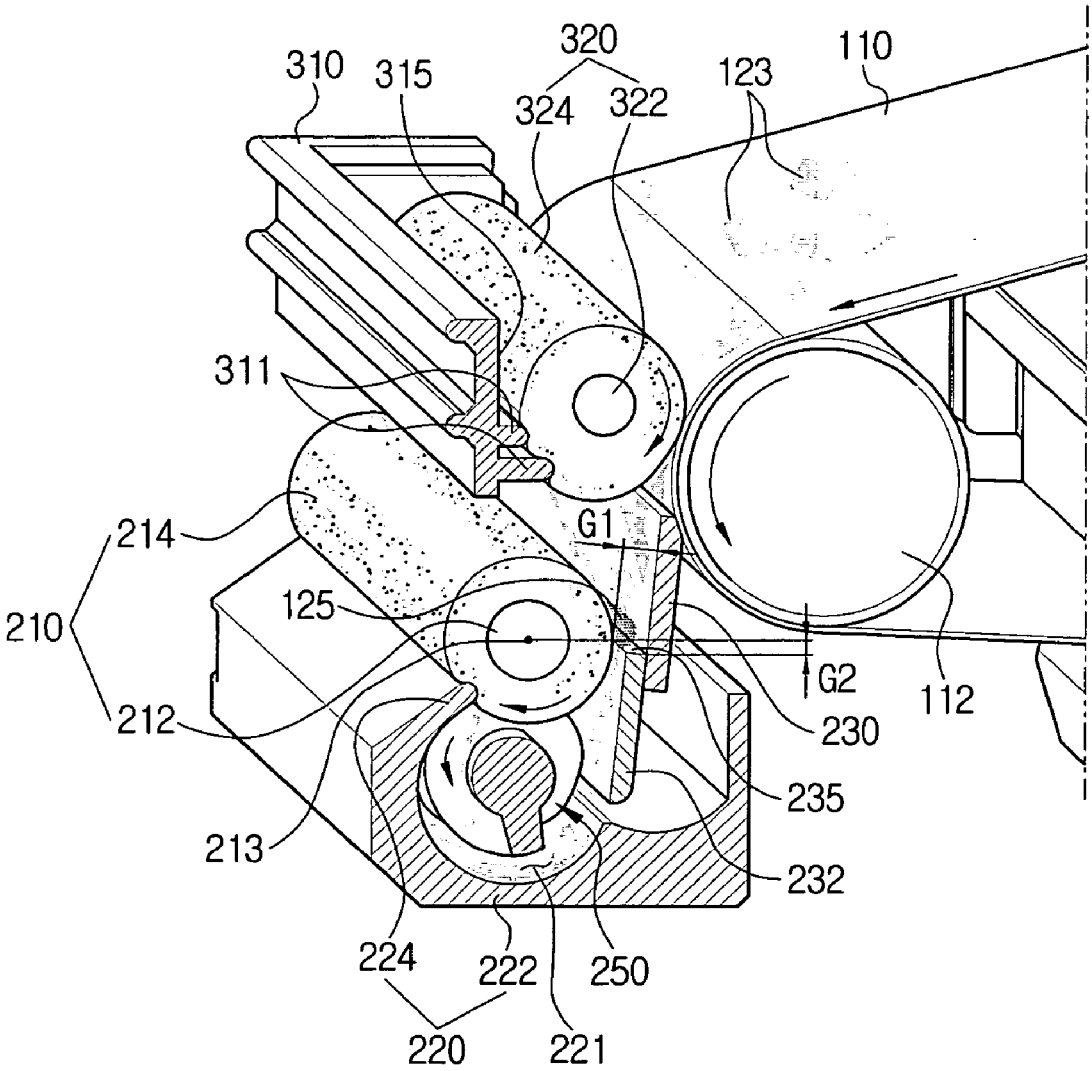
FIG. 3 is a cross-sectional perspective view showing a cross-sectional portion of the cleaning device shown in FIG. 2.
Figure 4:
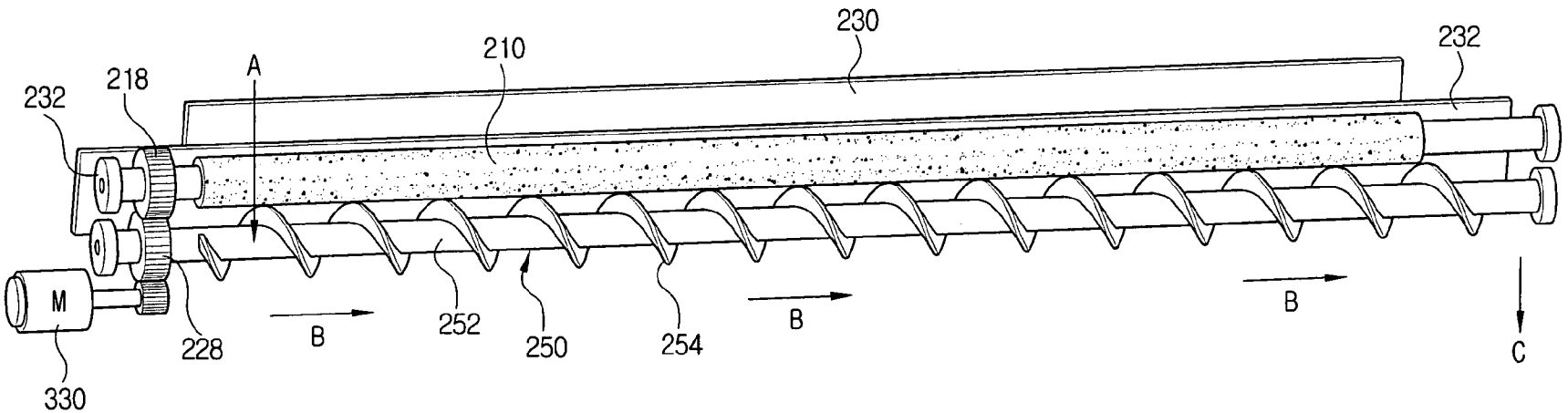
FIG. 4 is a perspective view showing the cleaning device shown in FIG. 2 without a pre-cleaning roller.

FIG. 2 is a perspective view showing a cleaning device in accordance with a first embodiment of the present invention. FIG. 3 is a cross-sectional perspective view of a cross-sectioned portion of the cleaning device shown in FIG. 2. FIG. 4 is a perspective view showing the cleaning device viewed in a different angle from FIG. 2.

With reference to FIGS. 2 and 3, the cleaning device 200 includes a pre-cleaning member 320, a pre-cleaning bracket 310, a first cleaning member 230, a support bracket 232, a second cleaning member 210, a developer transfer member 250, and a base bracket unit 220.

The pre-cleaning member 320 is allocated adjacent to a tension roller 112, and a transfer belt 110 is disposed between the pre-cleaning member 320 and the tension roller 112. Also, as the tension roller 112 rotates, the pre-cleaning member 320 starts rotating. The pre-cleaning member 320 has a length that is approximately a width of the transfer belt 110. As shown in FIG. 3, the pre-cleaning member 320 includes a first roller shaft 322 and a first sponge 324. The pre-cleaning member 320 is supported by the pre-cleaning bracket 310 and removes waste developers 123 remaining on the transfer belt 110 by pushing the waste developers 123 in a downward direction. Although the first embodiment shows the case of using the first sponge 324 as a material for forming the pre-cleaning member 320, any suitable material having elasticity and absorbability may be used.

The pre-cleaning bracket 310 is allocated on one side of the pre-cleaning roller 320. Hereinafter, since the pre-cleaning member 320 of this first embodiment is configured as a rotatable roller, the pre-cleaning member is also referred to as a pre-cleaning roller and denoted with the same reference numeral. The pre-cleaning bracket 310 rotatably supports both ends of the first roller shaft 322 of the pre-cleaning roller 320 and includes a first compress unit 311 on one surface.

As shown in FIG. 3, the first compress unit 311 protrudes out from one surface 315 facing the pre-cleaning roller 320, and compresses the first sponge 324 of the pre-cleaning roller 320 to squeeze out the waste developers 123 absorbed into the first sponge 324. A degree of the protrusion of the first compress unit 311 is preferably determined such that the first compress unit 311 has an adequate size that prevents rotational overload of the pre-cleaning roller 320.

The first cleaning member 230, as shown in FIG. 3, is disposed below the pre-cleaning roller 320, while the first cleaning member 230 is in contact with the transfer belt 110. Also, the first cleaning member 230 removes the waste developers 123 still remaining on the transfer belt 110 even after passing through the pre-cleaning roller 320. The first cleaning member 230 is configured as a plate type blade as shown in FIGS. 3 and 4 and, is angularly disposed to allow the waste developers 123 to run down easily. The first cleaning member 230 may adopt a conventionally used cleaning blade and, is preferably formed of a ductile material for preventing the transfer belt 110 from being damaged.

The support bracket 232 is allocated in a bottom portion of the first cleaning member 230 and supports the first cleaning member 230. Particularly, the support bracket 232 is attached to a predetermined portion of one surface of the first cleaning member 230, and in this embodiment, the support bracket 232 is attached to the predetermined portion in a direction facing the second cleaning roller 210. With reference to FIG. 4, the support bracket 232 also has a plate type configuration and is allocated long in a direction corresponding to a width of the transfer belt 110.

Referring to FIG. 3, the second cleaning member 210 is disposed a predetermined distance G1 apart on one side of the first cleaning member 230. The predetermined distance G1 preferably ranges from approximately 0.1 mm to approximately 0.3 mm. The reason for this range of the predetermine distance G1 is because, if the predetermined distance G1 is greater than this range, cleaning performance deteriorates, and if the predetermined distance G1 is less than this range, the second cleaning member 210 exerts a pressure to the first cleaning member 230 which in turn increasingly exerts a linear pressure to the transfer belt 110. This increase in linear pressure results in damage to the transfer belt 110. The second cleaning member 210 also includes a second roller shaft 212 and a second sponge 214. Hereinafter, since the second cleaning member 210 is configured as a rotatable roller, the second cleaning member is referred to as a second cleaning roller and denoted with the same reference numeral. Therefore, the second cleaning roller 210 is capable of absorbing the waste developers 123 deposited on the first cleaning member 230 and scrubbing the waste developers 123 for removal. Also, a central point 213 of the second cleaning roller 210 is preferably disposed above a top part 235 of the support bracket 232 in order to effectively remove the waste developers 123 remaining on the top part 235 of the support bracket 232. That is, a distance G2 between the central point 213 and the top part 235 is set to be greater than approximately 0. Also, as shown in FIG. 4, there is a first gear 218 on one side of the second cleaning roller 210, and this first gear 218 is placed above the developer transfer member 250.

As illustrated in FIG. 3, the developer transfer member 250 is disposed below the second cleaning roller 210 and is received in a chamber 221 formed in the base bracket unit 220. The developer transfer member 250, as shown in FIG. 4, is configured as a screw roller and has a screw type wing 254 at a rim of a third roller shaft 252. Also, the developer transfer member 250 includes a second gear 228 engaged with the first gear 218 of the second cleaning roller 210. As a result, as the developer transfer member 250 rotates after receiving power from a power source 330, such as a motor M, and the developer transfer member 250 transfers the waste developers 123 in a predetermined direction of 'B' as depicted in FIG. 4 and concurrently drives the second cleaning roller 210. Referring to FIG. 4, the power source 330 engaged with the second gear 228 of the developer transfer member 250 also may be configured to receive power. Also, the power source 330 is preferably configured to receive power from a photosensitive medium 150 (refer to FIGS. 10 and 11) of an image forming apparatus or from a drive source (not shown) that drives the transfer belt 110.

Referring to FIGS. 2 and 3, the base bracket unit 220 encloses the developer transfer roller 250 and forms the chamber 221 for temporarily collecting the waste developers 123. The base bracket unit 220 includes a main bracket body 222 and a second compress unit 224. Referring to FIG. 3, the main bracket body 222 and the second compress unit 224 are integrated in one body. However, it is still possible to configure the second compress unit 224 as a separate member. The main bracket body 222 accommodates the developer transfer member 250 and the waste developers 123. The second compress unit 224 compresses a predetermined portion of the second sponge 214 of the second cleaning roller 210 facilitating the waste developers 123 absorbed into the second cleaning roller 210 dropping into the chamber 221 of the main bracket body 222. Also illustrated in FIG. 2 is a mainframe bracket 270.

Figure 5:
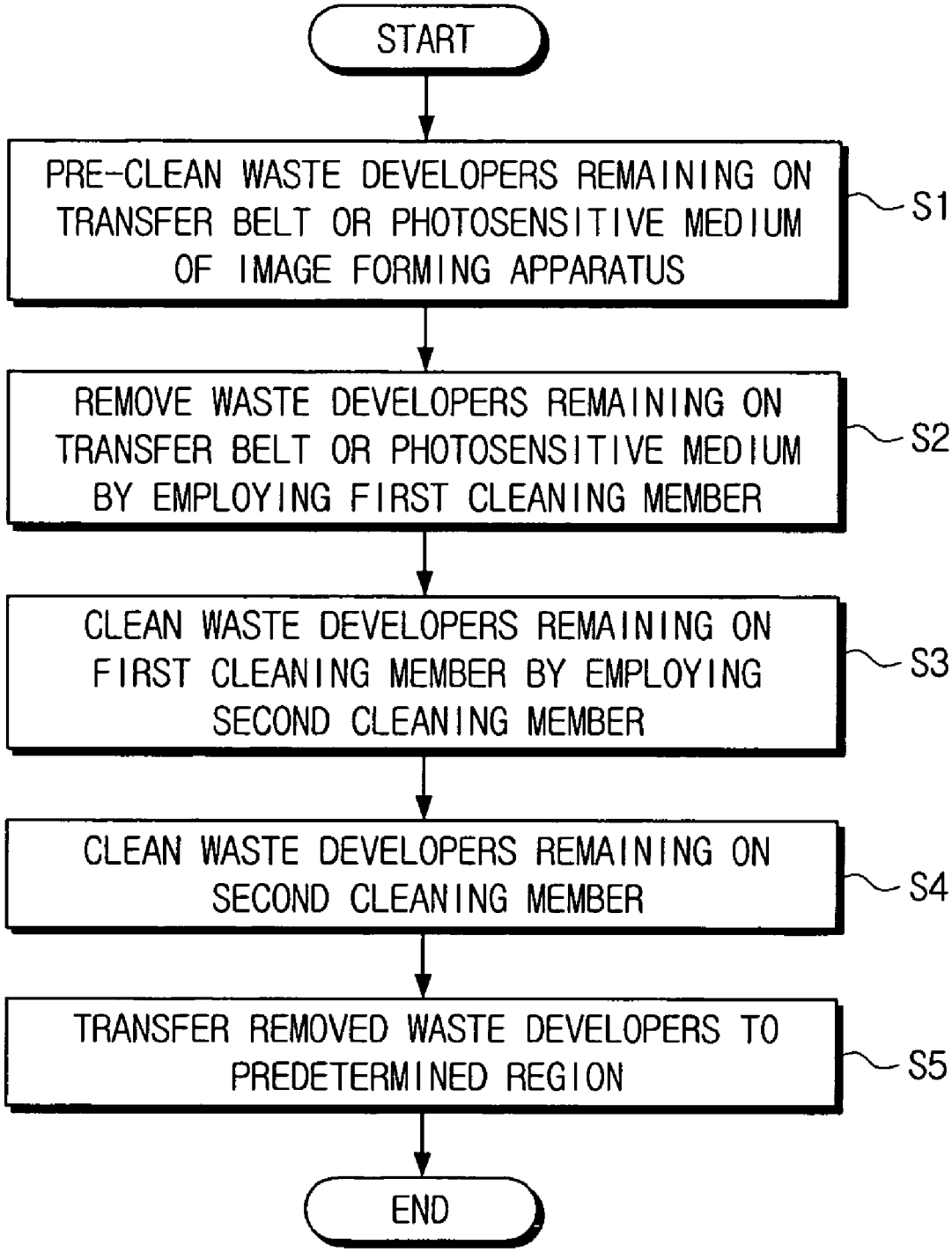
FIG. 5 is a flowchart for describing a cleaning method in accordance with a preferred embodiment of the present invention.

With reference to FIGS. 3 to 5, detailed description on a cleaning method in accordance with a preferred embodiment of the present invention will be provided in the following.

As shown in FIG. 5, at step S1, the pre-cleaning member 320 cleans the waste developers 123 remaining after being transferred to a piece of printing paper (not shown) from the transfer belt 110 or the photosensitive medium 150 (FIGS. 10 and 11) as the pre-cleaning member 320 rotates in contact with the transfer belt 110. At this time, the first sponge 324 of the pre-cleaning member 320 absorbs the waste developers 123, and rotates when engaged by the transfer belt 110 in a downward direction, thereby downwardly removing the waste developers 123.

Next, at step S2, the first cleaning member 230, formed as a blade type, removes the waste developers 123 remaining on the transfer belt 110 as the first cleaning member 230 contacts the transfer belt 110 at a bottom side of the pre-cleaning member 320. This is the first cleaning step. At this first cleaning step, the waste developers 123 remaining on the transfer belt 110 are almost removed. Although the waste developers 123 free-fall due to a gravitational force, because of the viscousness of the waste developer 123, the free-falling waste developers 123 are deposited on one surface of the first cleaning member 230.

Afterwards, a second cleaning step is carried out at step S3. That is, the second cleaning member 210 removes the waste developers 123 deposited on the first cleaning member 230. The second sponge 214 of the second cleaning member 210 absorbs the waste developers 123 and concurrently scrubs the waste developers 123 downwardly. This downward scrubbing action of the second sponge 214 is depicted as an arrow 'A' of FIG. 4. As a result of the second cleaning step S3, the quantity of the waste developers 123 deposited on the first cleaning member 230 decreases, and thus, a cleaning capability of the first cleaning member 230 is improved.

Also, at step S4, as the second cleaning member 210 rotates, the second cleaning member 210 is compressed by the second compress unit 224 of the base bracket unit 220, and as a result, the waste developers 123 absorbed into the second sponge 214 of the second cleaning member 210 are squeezed and drop down into the chamber 221 of the main bracket body 222. This step is the third cleaning step.

Subsequent to the third cleaning step, the developer transfer member 250, at step S5, transfers the removed waste developers 123 in a predetermined direction to an exit (not shown). The predetermined direction is illustrated with a reference arrow 'B' in FIG. 4. The transferred waste developers 123 free-fall to the exit (not shown) and are collected at a waste developer disposal bin (not shown).

The cleaning device and the cleaning method as described above prevent the waste developers 123 from accumulating and depositing on the first cleaning member 230, thereby increasing cleaning efficiency of the first cleaning member 230 and protecting the transfer belt 110 against damage.

Figure 1:
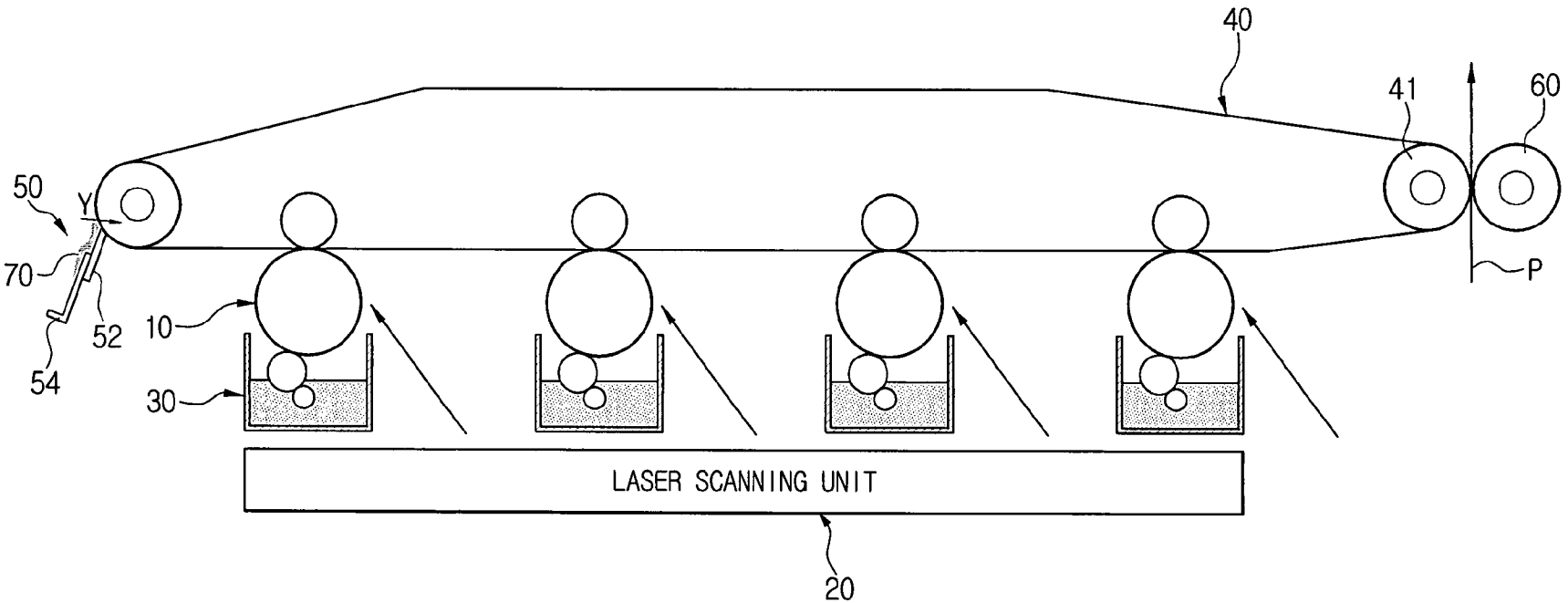
FIG. 1 (PRIOR ART)
FIG. 1 is a diagram schematically showing a conventional cleaning device.
Figure 6:
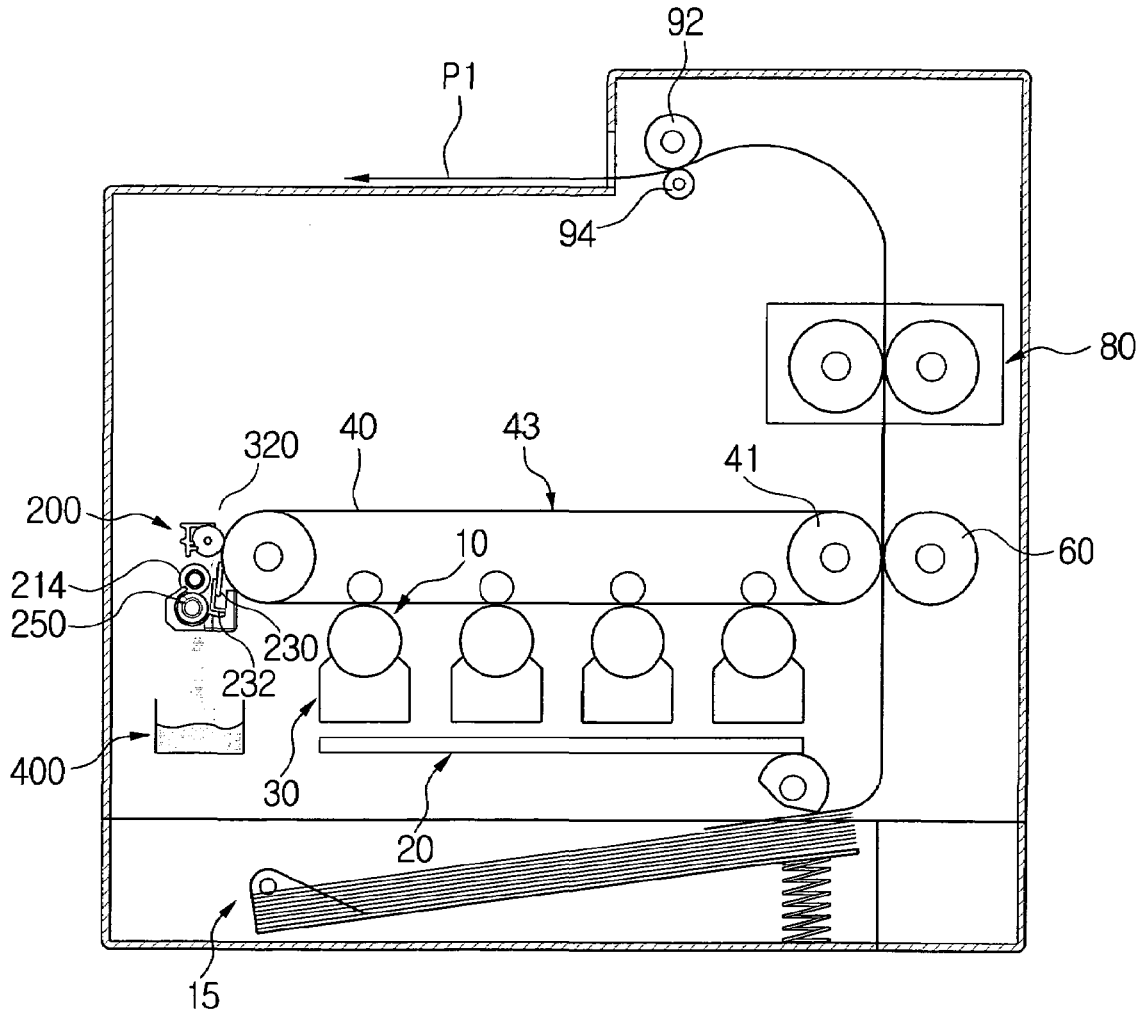
FIG. 6 is a cross-sectional view showing one preferably embodied image forming apparatus in accordance with the present invention.

FIG. 6 is a diagram showing one preferred embodiment of the image forming apparatus in accordance with the present invention. Particularly, the image forming apparatus shown in FIG. 6 is a wet-type color image forming apparatus to which the above described first embodied cleaning device is applied. Herein, it should be noted that the same reference numerals are used for the same configuration elements of the conventional image forming apparatus described in FIG. 1.

As shown in FIG. 6, the image forming apparatus includes a paper feed device 15, a number of developing units 30, a scanning unit 20, a transfer unit 43, a cleaning device 200, and a fixing device 80. The cleaning device 200 has the same configuration as the first embodied cleaning device. Since other configuration elements are identical or similar to the conventional image forming apparatus, detailed description on such configuration elements will be omitted. Therefore, mainly operation of the image forming apparatus will be explained.

Once the scanning unit 20 generates electrostatic latent images on photosensitive drums 10 for each color, each color developer is transported from each of the color developer units 30 to each of the photosensitive drums 10 for each color to thereby generate an image for each color. Each color developer existing on the photosensitive drums 10 is subjected to a first transfer step in which each color developer is transferred to the moving transfer belt 40 by a driving roller 41. At this time, each color developer may be superimposed with each other.

The color images transferred on the first transfer belt 40 are transferred as visible images on a piece of printing paper P being supplied from the paper feed device 15 and pass through a space created between the drive roller 41 and the transfer roller 60. Then, as the piece of printing paper P passes through the fixing device 80, the visible images are fixed on the piece of printing paper P by heat and pressure and are discharged to a paper loading tray through a pair of paper discharge rollers 92 and 94.

Those waste developers remaining on the transfer belt 40 after the first transfer of the generated images on the piece of printing paper P are transported to the cleaning device 200. As described in the first embodiment of the cleaning device above, the waste developers 123 are removed by the pre-cleaning member 320, the first cleaning member 230 and the second cleaning member 210 and then, transferred to a waste developer disposal bin 400 by the developer transfer member 250 (FIGS. 2 and 3).

The image forming apparatus, which is one of various embodiments of the cleaning device, may be formed in numerous configurations. For instance, the image forming apparatus can be configured in a monochrome image forming apparatus, wherein a cleaning device is applied to a photosensitive drum shown in FIGS. 10 and 11, a color image forming apparatus, a dry type image forming apparatus using a solid developer, namely a toner, and a wet type image forming apparatus using a liquid developer.

Figure 7:
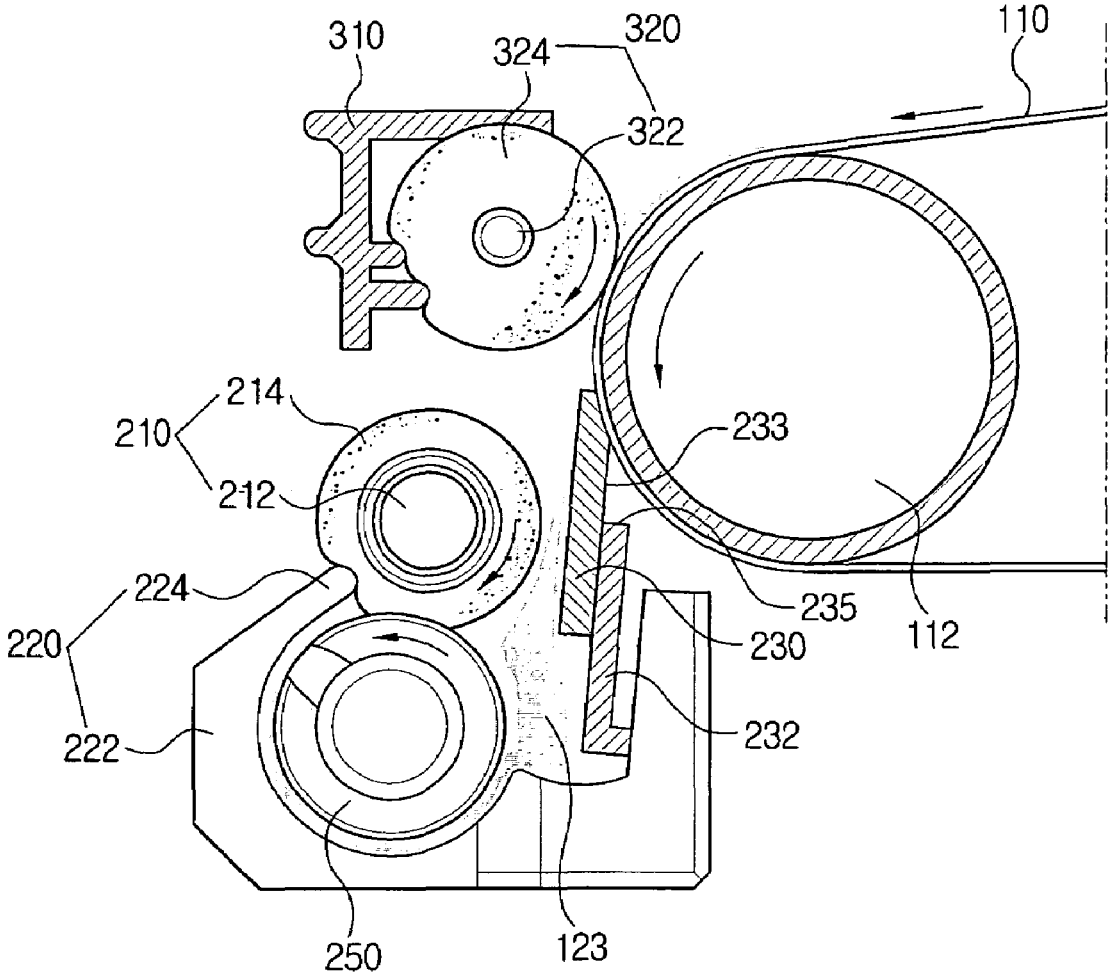
FIG. 7 is a cross-sectional view showing a cleaning device in accordance with a second embodiment of the present invention.

FIG. 7 is a cross-sectional view showing a cleaning device in accordance with a second embodiment of the present invention. Herein, since most of configuration elements are identical to those described in the first embodiment, the same reference numerals are used.

As shown, being different from the first embodiment of the cleaning device, a support bracket 232 for supporting a first cleaning member 230 is attached to the first cleaning member 230 at a different position. That is, in the second embodiment, the support bracket 232 is attached to a surface 233 of the first cleaning member 230 so that the support bracket 232 does not face the second cleaning member 210. This special configuration of the support bracket 232 facilitates preventing waste developers 123 removed at the transfer belt 110 from being collected on a top part 235 of the support bracket 232. The rest of the configuration elements and a cleaning method are same as the first embodiment, and thus, detailed description on those configuration elements and the cleaning method will be omitted.

Figure 8:
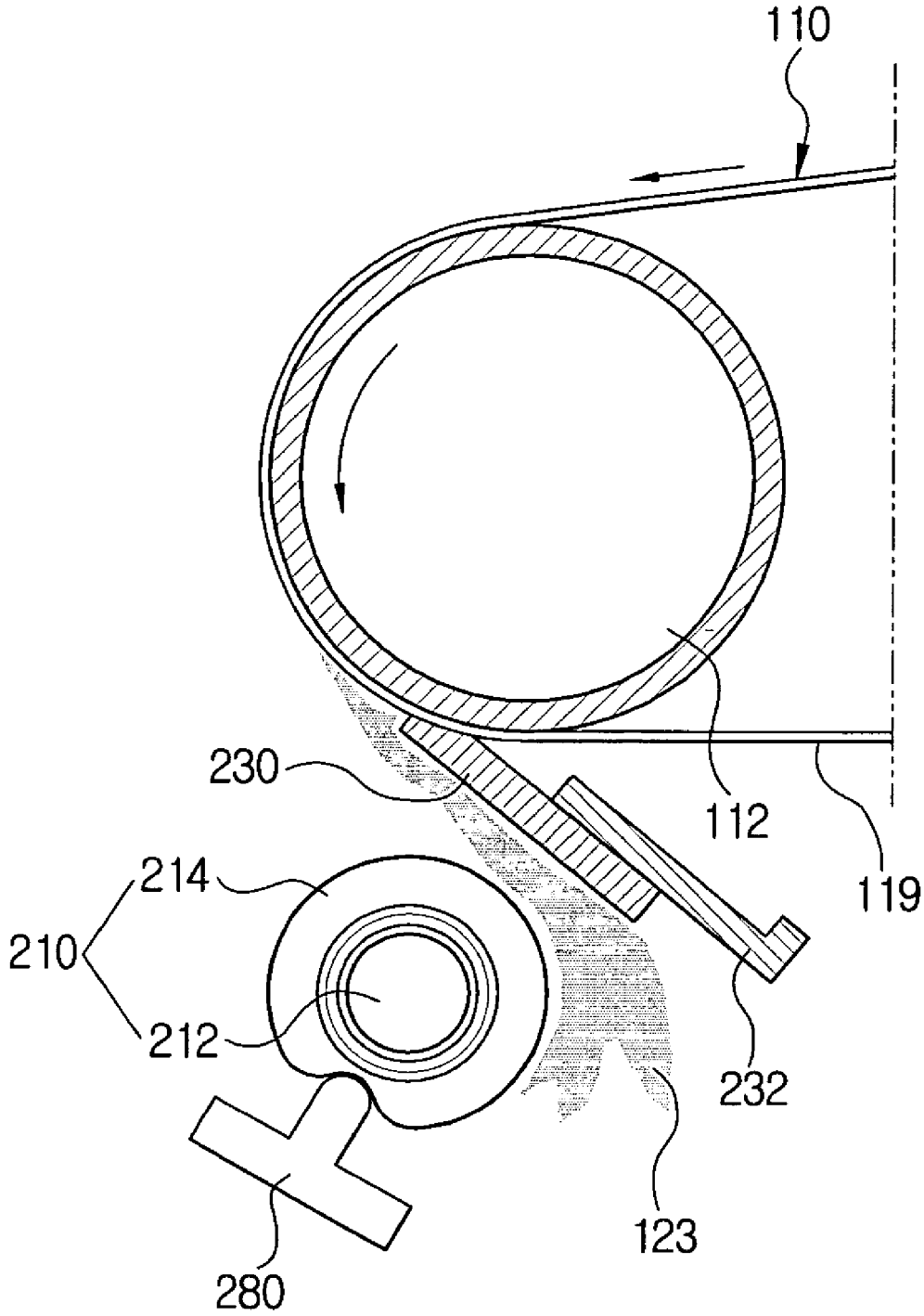
FIG. 8 is a cross-sectional view showing a cleaning device in accordance with a third embodiment of the present invention.

FIG. 8 is a cross-sectional view showing a cleaning device in accordance with a third embodiment of the present invention. Herein, since most of configuration elements are identical to those described in the first embodiment, the same reference numerals are used.

As shown in FIG. 8, a first cleaning member 230, a support bracket 232 and a second cleaning member 210 are disposed below a transfer belt 110. The first cleaning member 230 is in contact with a bottom part 119 of the transfer belt 110 and is tilted in a forward moving direction of the transfer belt 110. Also, the second cleaning member 210 is disposed at a lateral bottom side of the first cleaning member 230, and a compress member 280 is disposed on one side of the second cleaning member 210.

In this embodiment, most of the waste developers 123 cleaned by the fist cleaning member 230 free-fall. In the case that the waste developer 123 is of a viscous liquid type, the waste developers 123 may accumulate together on the first cleaning member 230. However, the second cleaning member 210 can remove the agglomerated waste developers 123. The compress member 280, for removing the waste developers 123 absorbed by the second cleaning member 210, is separately disposed. Herein, the rest of the configuration elements and a cleaning method are same as the first embodiment, and thus, detailed description on those configuration elements and the cleaning method will be omitted.

Figure 9A:
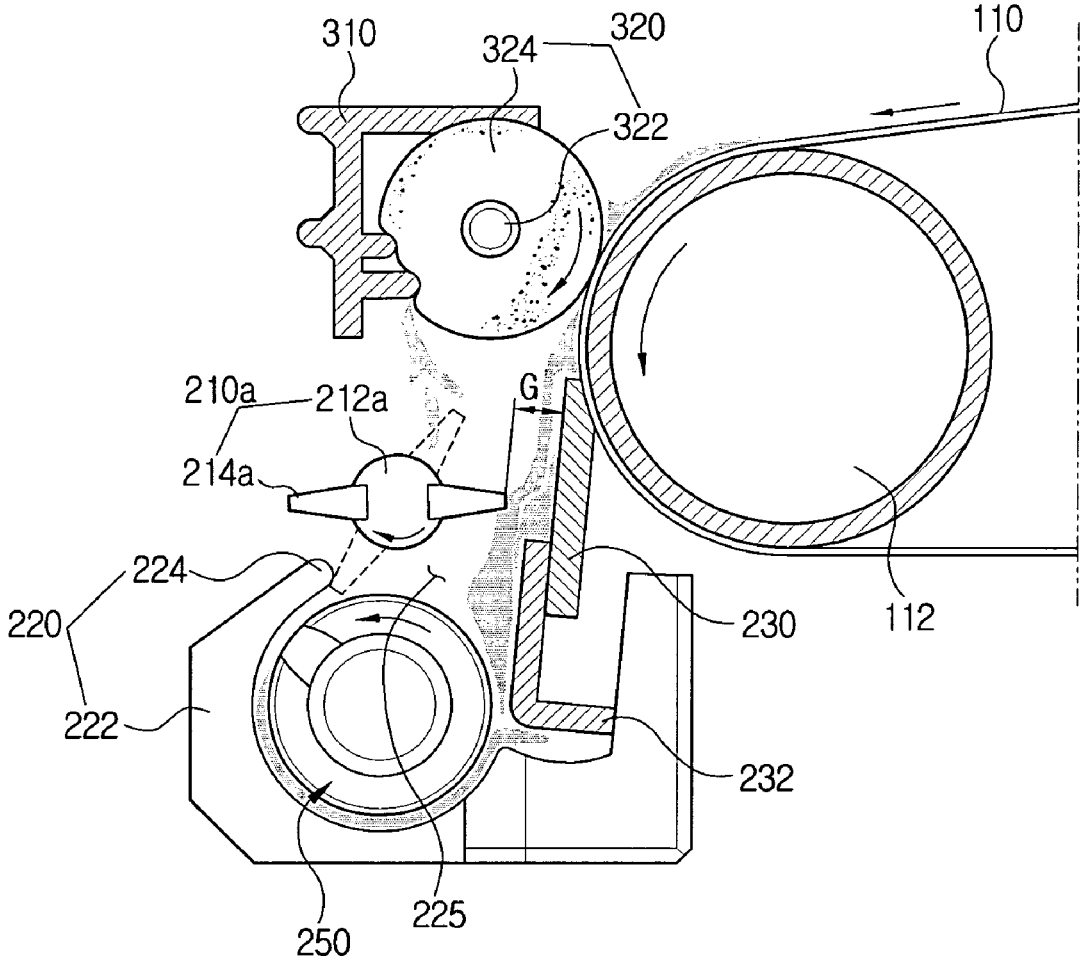
FIG. 9A is a cross-sectional view showing a cleaning device in accordance with a fourth embodiment of the present invention.
Figure 9B:
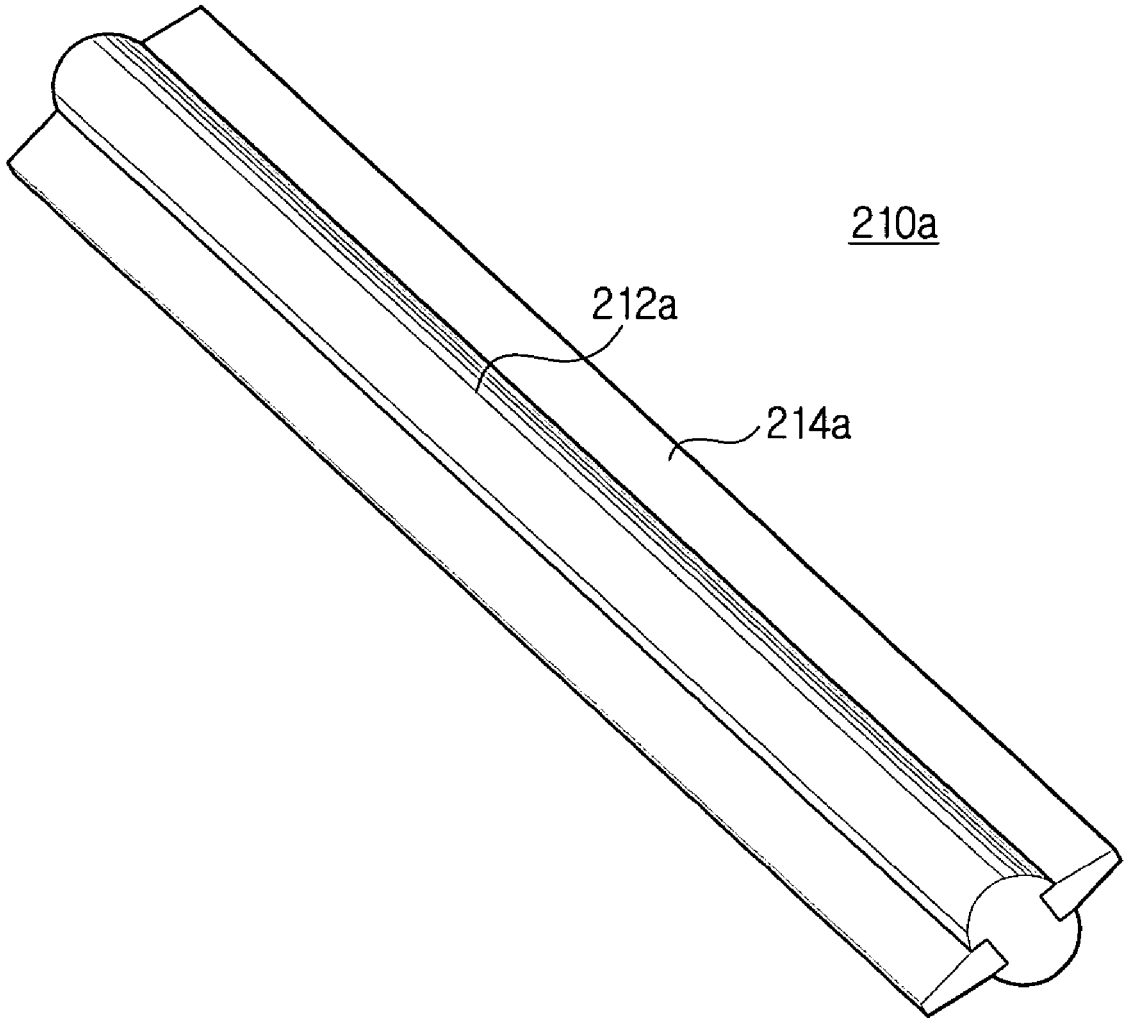
FIG. 9B is a perspective view showing a second cleaning roller illustrated in FIG. 9A.

FIGS. 9A and 9B are diagrams showing a cleaning device in accordance with a fourth embodiment of the present invention. Particularly, FIG. 9A is a cross-sectional view of the cleaning device, and FIG. 9B is a perspective view of a second cleaning member of the cleaning device shown in FIG. 9A.

The cleaning device in accordance with the fourth embodiment is similar to the first embodied cleaning device. However, a second cleaning member 210*a* is differently configured by including a rotation shaft 212*a* and a pair of elastic blades 214*a*. Although the pair of elastic blades 214*a* is coupled with the rotation shaft 212 such that the two elastic blades 214*a* face each other in a symmetrical manner in this fourth embodiment, the configuration of the elastic blade 214*a* may vary. That is, the number of the elastic blade 214*a* may be one or more than two. Herein, since other configuration elements and a cleaning method are same as the first embodiment, detailed description on those configuration elements and the cleaning method will be omitted.

Describing the elastic blade 214*a* in more detail, the elastic blade 214*a* is preferably made of a urethane-based material. Also, a gap G illustrated in FIG. 9A, is a distance between the selected elastic blade 214*a* and the first cleaning member 230. That is, as shown in FIG. 9A, when the selected elastic blade 214*a* is positioned horizontally, the gap G is the distance from one edge surface of the selected elastic blade 214*a* to a surface of the first cleaning member 230. Preferably, the gap G ranges from approximately 0.1 mm to approximately 0.3 mm. This predetermined range of the gap G is based on the same reasons described in the first embodiment of the cleaning device. Also, in case that the second cleaning member 210*a* includes two elastic blades 214*a*, as in the fourth embodiment, a rotation ratio of the second cleaning member 210*a* to a developer transfer member 250 is preferably approximately 2 to approximately 1. The reason for this specific ratio is because the second cleaning member 210*a* closes an opened upper part 225 of a base bracket unit 220 as the second cleaning member 210*a* rotates approximately twice as fast as the developer transfer member 250, and as a result, it is possible to improve transfer efficiency of the waste developers 123. Furthermore, a second compress unit 224 of the base bracket unit 220 removes the waste developers 123 remaining on the elastic blades 214*a*. This removal of the waste developers 123 is depicted as a dotted line in FIG. 9A.

Referring to FIG. 9B, the second cleaning member 210*a* includes circular rotation shaft 212*a* and the pair of elastic blades 214*a* are coupled with the circular rotation shaft 212*a*. Preferably, the thickness of the pair of elastic blades 214*a* is minimized from an inner to an outer edge. In addition to the circular shape, it is still possible to form the rotation shaft 212*a* in triangular or polygonal shape, and the elastic blade 214*a* can also be formed in various shapes. Instead of the elastic blades 214*a*, the rotation shaft 212*a* can be implanted with bristles.

Figure 10:
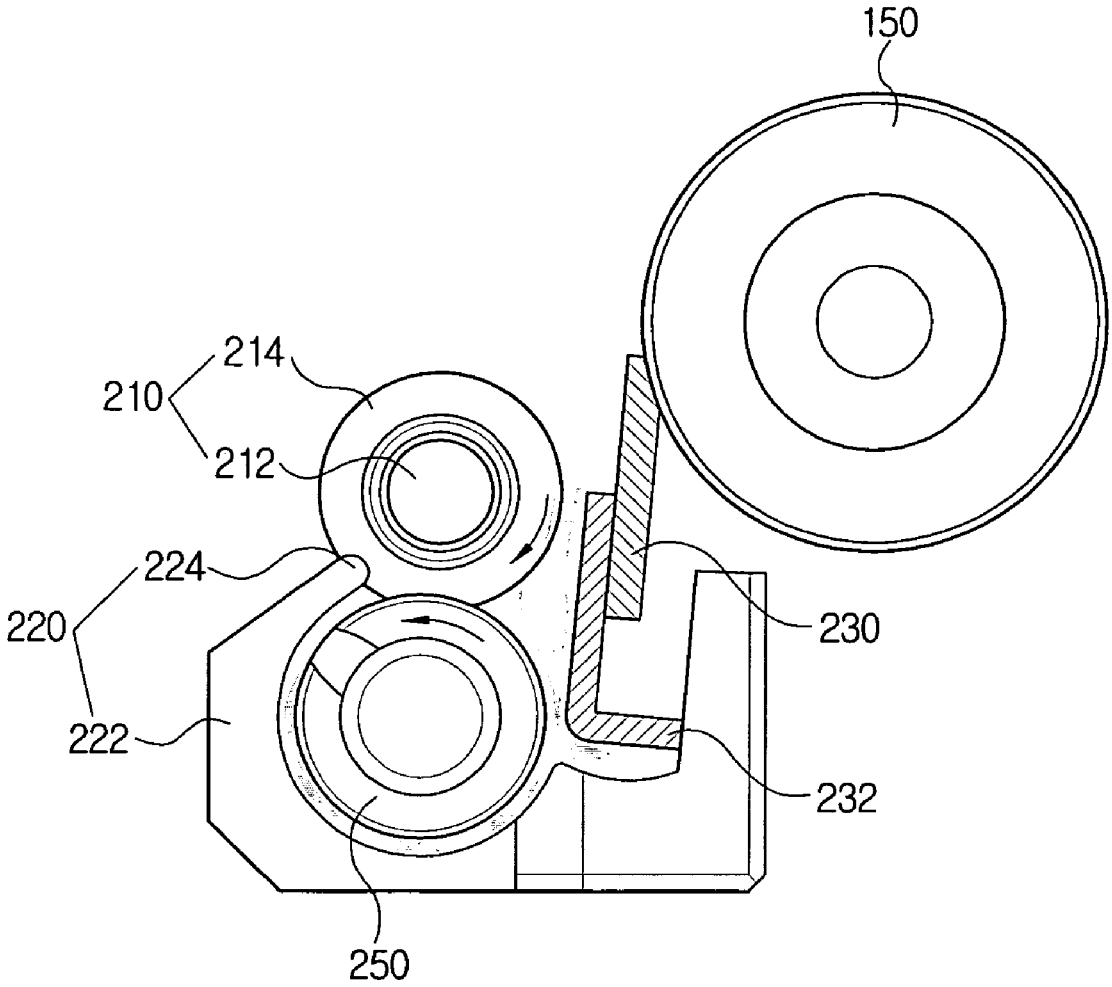
FIG. 10 is a diagram showing a cleaning device applied to a photosensitive drum of a monochrome image forming apparatus, wherein a second cleaning roller is configured with a sponge.
Figure 11:
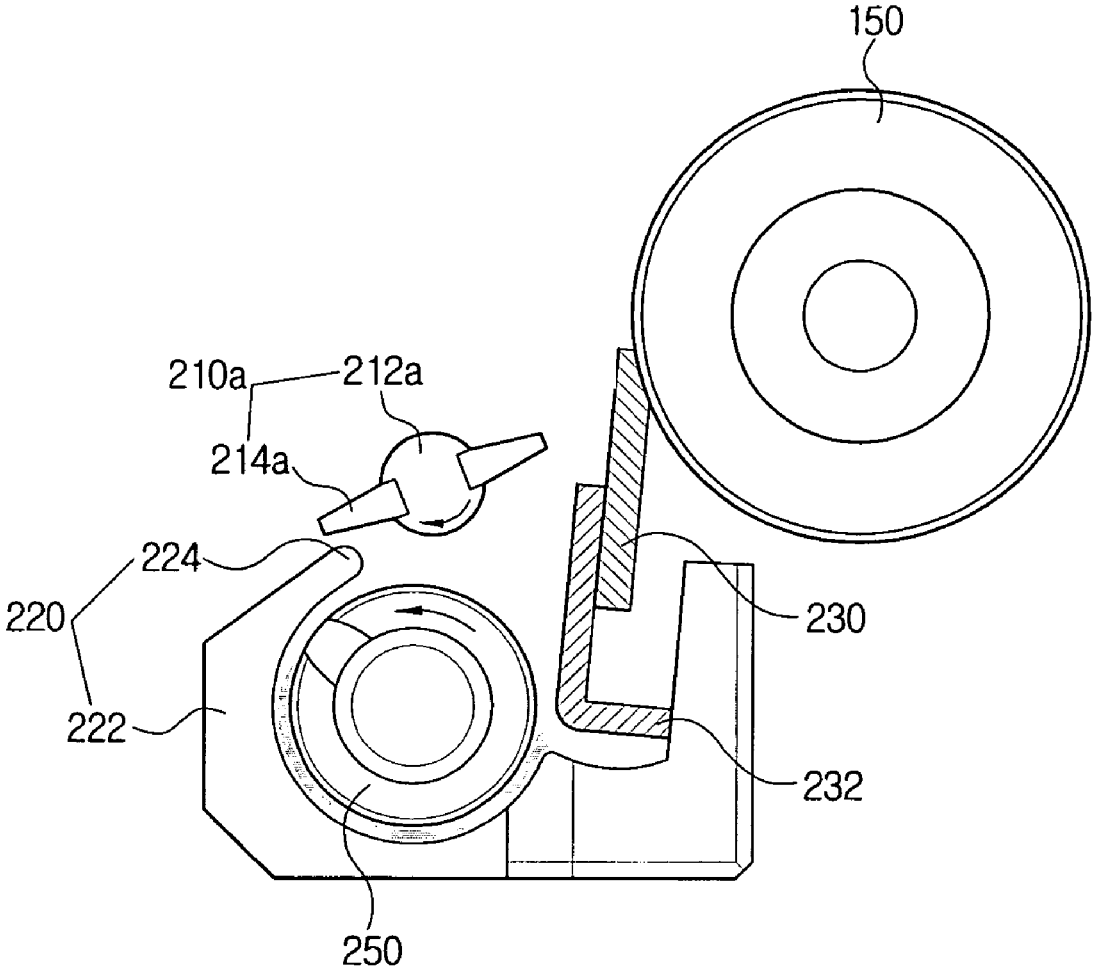
FIG. 11 is a diagram showing a cleaning device applied to a photosensitive drum of a monochrome image forming apparatus, wherein a second cleaning roller is configured with an elastic blade.

FIG. 10 is a diagram showing a cleaning device applied to a photosensitive medium 150, more particularly, a photosensitive drum in a monochrome image forming apparatus. FIG. 11 is a diagram showing a cross-sectional view of another embodied cleaning device, wherein a second cleaning member 210 of FIG. 10 is formed in a different shape. For the same configuration elements described in the above embodiments, the same reference numerals are used.

With reference to FIGS. 10 and 11, the cleaning devices applied to the monochrome image forming apparatus vary from the first embodiment, the second embodiment and the fourth embodiment. That is, the cleaning devices shown in FIGS. 10 and 11 do not have a pre-cleaning member 320 as shown in FIG. 3, instead, each of the cleaning devices includes a first cleaning member 230, a support bracket 232, a second cleaning member denoted with a reference numeral 210 in FIG. 10 and with a reference numeral 210*a* in FIG. 11, a developer transfer member 250, and a base bracket unit 220. Particularly, the second cleaning member can be formed as a rotatable roller with use of a sponge 214 (indicated at 210 in FIG. 10), or as another rotatable roller using elastic blades 214*a* (indicated at 210*a* in FIG. 11). The detailed configuration and operation of the rest configuration elements are identical to the above described embodiments, and thus, description on such configuration elements and operation will be omitted.

While the invention has been shown and described with reference to certain embodiments thereof, it will be understood by those skilled in the art that various changes in form and details may be made therein without departing from the spirit and scope of the invention as defined by the appended claims.

What is claimed is:

1. A cleaning device for an image forming apparatus comprising:

a pre-cleaning member to remove waste developers remaining on one of a photosensitive medium and a transfer belt prior to cleaning:

a cleaning blade to remove waste developers remaining on one of the photosensitive medium and the transfer belt to clean the photosensitive medium or transfer belt; and a cleaning member being disposed on one side of the cleaning blade to remove the waste developers remaining on the cleaning blade.

2. The cleaning device of claim 1, wherein the pre-cleaning member comprises a rotatable roller having a roller shaft being a rotation axle and an absorption member enclosing an outer surface of the roller shaft.

3. A cleaning device for an image forming apparatus comprising:

a cleaning blade to remove waste developers remaining on one of a photosensitive medium and a transfer belt; and a cleaning member disposed on one side of the cleaning blade to remove the waste developers remaining on the cleaning blade;

wherein the cleaning blade is disposed substantially below the photosensitive medium or the transfer belt while the cleaning blade is in contact with a surface of the photosensitive medium or the transfer belt.

4. An image forming apparatus, comprising:

a main body;

a scanning unit being disposed within the main body for generating an electrostatic latent image on a photosensitive medium;

an image forming unit generating a visible image on the photosensitive medium by using a developer, and transferring the visible image to a piece of printing paper; and a cleaning device to remove waste developers remaining on the photosensitive medium, comprising:

a first cleaning member to remove waste developers remaining on the photosensitive medium;

a support bracket to support the first cleaning member; and a second cleaning member being disposed on one side of the first cleaning member to remove the waste developers remaining on the first cleaning member, wherein said second cleaning member comprises an absorption member.

5. The image forming apparatus of claim 4, wherein the cleaning device further comprising a developer transfer member to transfer the removed waste developers.

6. The image forming apparatus of claim 5, wherein the cleaning device further comprises a base bracket unit to receive the developer transfer member.

7. The image forming apparatus of claim 6, wherein the second cleaning member comprises a rotatable roller having a roller shaft being a rotation axle and where said absorption member encloses an outer surface of the roller shaft.

8. An image forming apparatus, comprising:

a main body;

a scanning unit being disposed within the main body to generate an electrostatic latent image on a photosensitive medium;

a developing unit generating a visible image on the photosensitive medium by using a developer;

a transfer unit comprising a transfer belt to transfer the visible image on the photosensitive medium to a piece of printing paper; and a cleaning device to remove waste developers remaining on the transfer belt, comprising:

a first cleaning member to remove waste developer remaining on the transfer belt;

a support bracket to support the first cleaning member;

a second cleaning member being disposed on one side of the first cleaning member to remove the waste developers remaining on the first cleaning member; and a compressing unit positioned to clean the second cleaning member.

9. The image forming apparatus of claim 8, wherein the cleaning device further comprises a developer transfer member to transfer the removed waste developers.

10. The image forming apparatus of claim 9, wherein the cleaning device further comprises a base bracket unit to receive the developer transfer member.

11. The image forming apparatus of claim 8, wherein the second cleaning member comprises a rotatable roller comprising a roller shaft being a rotation axle and an absorption member enclosing an outer surface of the roller shaft.

12. The image forming apparatus of claim 8, wherein the first cleaning member is disposed substantially below the transfer belt while the first cleaning member is in contact with a surface of the transfer belt.

13. The image forming apparatus of claim 8, further comprising:

a bracket member supporting a developer transfer member to transfer waste developer, said bracket member having a main body to collect removed waste developer removed form said second cleaning member, and where said compressing unit is supported by said bracket member.

14. A cleaning method of an image forming apparatus, comprising the steps of:

a pre-cleaning step to pre-clean waste developers remaining on one of a transfer belt and a photosensitive medium prior to a first cleaning step;

a first cleaning step to remove waste developers remaining on one of a transfer belt and a photosensitive medium of the image forming apparatus through the use of a cleaning blade; and a second cleaning step to clean waste developers remaining on the cleaning blade through the use of a cleaning member.

15. The cleaning method of claim 14, further comprising the step of transferring the removed waste developers to a predetermined region.

16. The cleaning method of any of claim 14, further comprising the step of cleaning the waste developers remaining on the cleaning member.

* * * * *